US012751571B2

(12) United States Patent
Chan

(10) Patent No.: US 12,751,571 B2
(45) Date of Patent: Oct. 6, 2026

(54) HANGER WITH A DOUBLE TORSION SPRING COIL CLIP AND HOOK SWING LIMITER

(71) Applicants: Uniplast Industries, Inc., Hasbrouk Heights, NJ (US); King Keung Kennedy Chan, Pokfulam (HK)

(72) Inventor: King Keung Kennedy Chan, Pokfulam (HK)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 0 days.

(21) Appl. No.: 18/785,427

(22) Filed: Jul. 26, 2024

(65) Prior Publication Data

US 2025/0325129 A1 Oct. 23, 2025

Related U.S. Application Data

(60) Provisional application No. 63/637,131, filed on Apr. 22, 2024.

(51) Int. Cl.

| | |
|---|---|
| ***A47G 25/48*** | (2006.01) |
| ***A47G 25/32*** | (2006.01) |
| ***A47G 25/36*** | (2006.01) |
| ***A47G 25/44*** | (2006.01) |

(52) U.S. Cl.

CPC ..... *A47G 25/482* (2013.01); *A47G 25/32* (2013.01); *A47G 25/36* (2013.01); *A47G 25/446* (2013.01)

(58) Field of Classification Search

CPC ..... A47G 25/32; A47G 25/485; A47G 25/36

USPC ..... 223/DIG. 4

See application file for complete search history.

(56) References Cited

U.S. PATENT DOCUMENTS

| | | | | | |
|---|---|---|---|---|---|
| 651,970 | A * | 6/1900 | Kavle | A47G 25/483 | 24/567 |
| 1,367,181 | A * | 2/1921 | Fonville | D06F 55/02 | 24/566 |
| 2,421,307 | A * | 5/1947 | Albrecht | A47G 25/485 | 223/96 |
| 2,483,303 | A * | 9/1949 | Rysick | A47G 25/485 | 211/89.01 |
| 2,889,092 | A * | 6/1959 | Gibron | A47G 25/485 | 211/89.01 |

(Continued)

FOREIGN PATENT DOCUMENTS

GB 2240036 A * 7/1991 ..... A47G 25/4038

*Primary Examiner* — Nathan E Durham

(74) *Attorney, Agent, or Firm* — Leason Ellis LLP

(57) ABSTRACT

An eco-friendly hanger includes a crossbar and a pair of first clips and a pair of second clips, each of the pair of first clips and the pair of second clips moving between an open position configured to receive an article and a closed position configured to grasp the article. The hanger includes first and second coil springs. The first coil spring biasedly couples the pair of first clips to one another and the second coil spring biasedly couples the pair of second clips to one another. The first coil spring includes a first spring arm that is coupled to one first clip and a second spring arm that is coupled to the other first clip such that in an at rest state, the pair of first clips are in the closed position. The second coil spring includes a first spring arm that is coupled to one second clip and a second spring arm that is coupled to the other second clip such that in an at rest state, the pair of second clips are in the closed position.

11 Claims, 17 Drawing Sheets

(56) References Cited

U.S. PATENT DOCUMENTS

| | | | | | |
|---|---|---|---|---|---|
| 2,939,588 | A * | 6/1960 | Nalle, Jr. | D06F 59/00 | 211/89.01 |
| 3,478,943 | A * | 11/1969 | Lucien | A47G 25/32 | D6/319 |
| 4,185,768 | A * | 1/1980 | Treiman | A47G 25/32 | 223/85 |
| 4,312,464 | A * | 1/1982 | Treiman | A47G 25/32 | 211/115 |
| 4,746,039 | A * | 5/1988 | Batts | A47G 25/485 | D6/326 |
| 4,984,721 | A * | 1/1991 | Eiley | A47G 25/485 | 223/91 |
| 5,546,640 | A * | 8/1996 | Kronauer | A47G 25/485 | 24/516 |
| 5,915,605 | A * | 6/1999 | Blanchard | A47G 25/485 | 223/91 |
| 2009/0283556 | A1* | 11/2009 | Ho | A47G 25/183 | 223/85 |
| 2022/0304490 | A1* | 9/2022 | Ho | A47G 25/1428 | |

* cited by examiner

HANGER WITH A DOUBLE TORSION SPRING COIL CLIP AND HOOK SWING LIMITER

CROSS REFERENCE TO RELATED APPLICATION

This application is based on and claims priority to U.S. Provisional Patent Application 63/637,131, filed Apr. 22, 2024, the entire contents of which is incorporated by reference herein as if expressly set forth in its respective entirety herein.

TECHNICAL FIELD

The present technology is generally related to garment hangers and, more particularly to an eco-friendly hanger that includes a double torsion spring coil clip and a hook swing limiter for limiting movement of the hook.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

A traditional type of garment hanger includes a metal hook which is received in and mates to a threaded boss located on the upper frame. More specifically, one end of the metal hook is a threaded end that mates with the threaded boss. The body of the hanger is typically made of plastic.

Accordingly, the majority of hanger used for display in department stores are made of plastic, which causes significant harm to the environment. It is therefore desirable to develop a display hanger made from natural plant fiber. Unlike plastic materials, natural plant fiber cannot be molded into various shapes using injection molding machines and molds to conveniently accommodate all accessories. Therefore, there is a need to redesign all accessories in order to develop hangers made from natural plant fiber materials.

SUMMARY OF THE DISCLOSURE

An eco-friendly hanger includes a crossbar and a pair of first clips and a pair of second clips, each of the pair of first clips and the pair of second clips moving between an open position configured to receive an article and a closed position configured to grasp the article. The hanger includes first and second coil springs. The first coil spring biasedly couples the pair of first clips to one another and the second coil spring biasedly couples the pair of second clips to one another. The first coil spring includes a first spring arm that is coupled to one first clip and a second spring arm that is coupled to the other first clip such that in an at rest state, the pair of first clips are in the closed position. The second coil spring includes a first spring arm that is coupled to one second clip and a second spring arm that is coupled to the other second clip such that in an at rest state, the pair of second clips are in the closed position.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
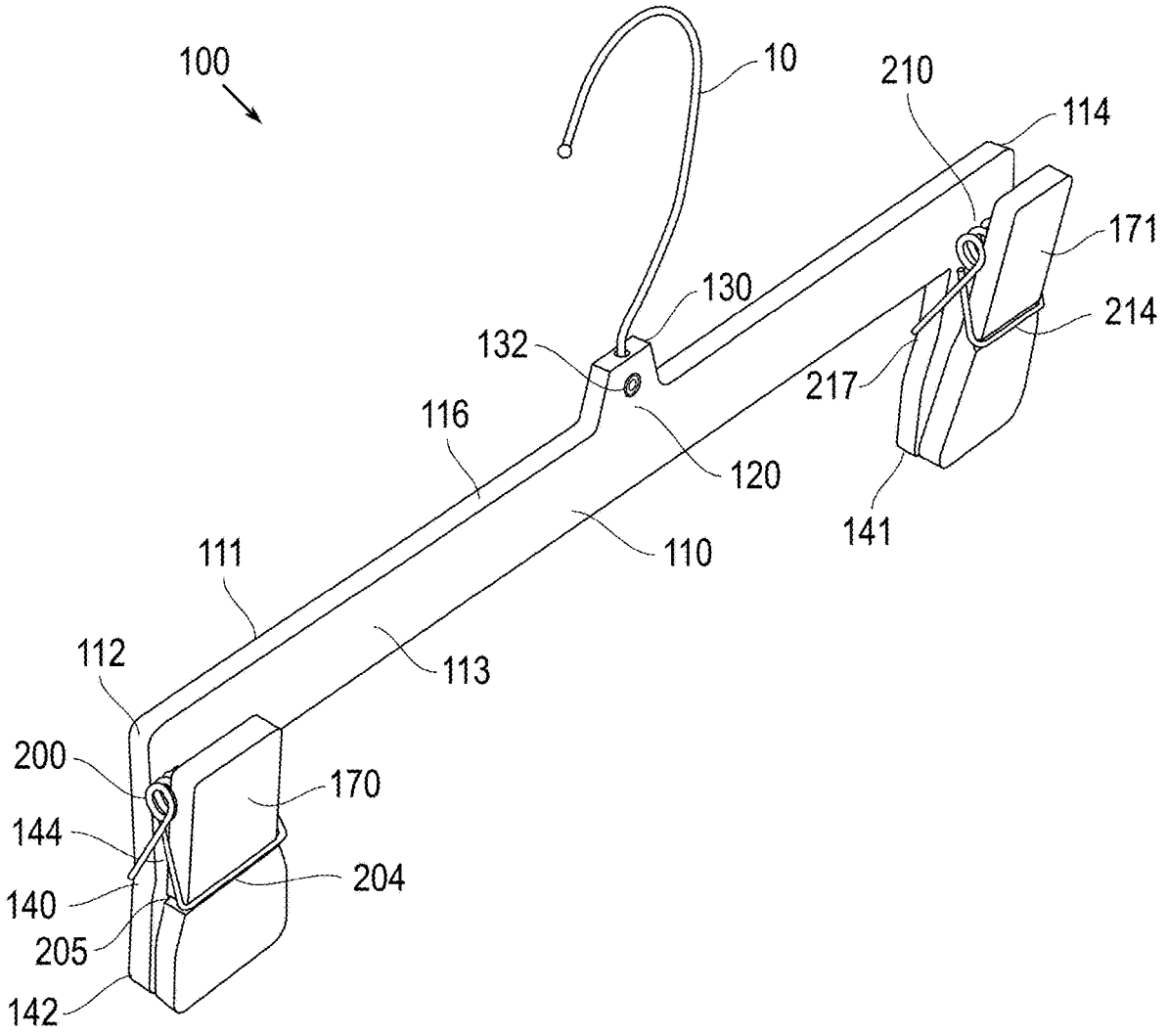
FIG. 1 is a front perspective view of an eco-friendly hanger according to a first embodiment.
Figure 2:
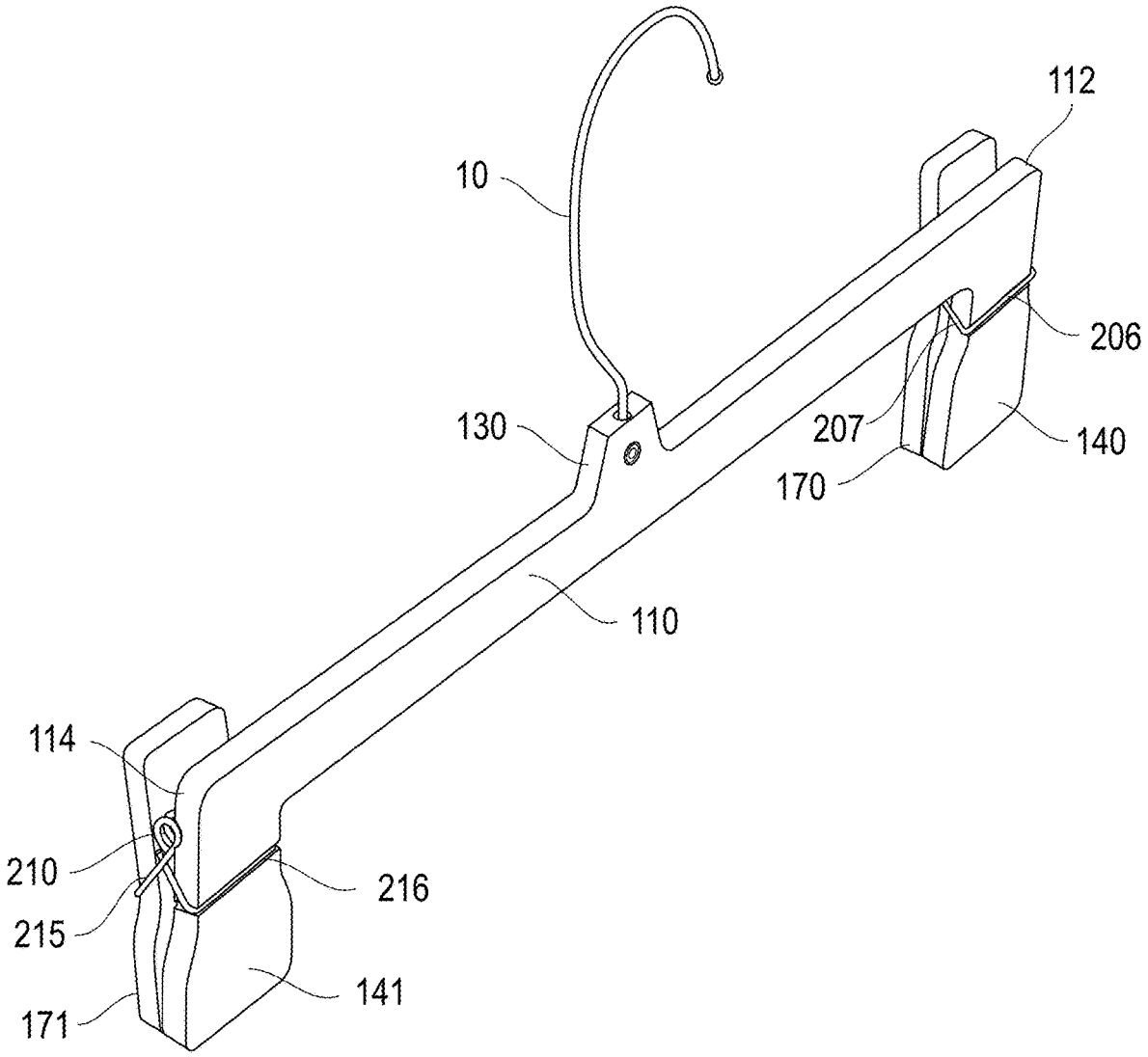
FIG. 2 is a rear perspective view thereof.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

The present disclosure sets forth eco-friendly hangers that each includes a double torsion spring coil clip and a hook swing limiter for limiting movement of the hook.

Definitions

The terms used in this specification generally have their ordinary meanings in the art, within the context of this invention and the specific context where each term is used. Certain terms are discussed below, or elsewhere in the specification, to provide additional guidance to the practitioner in describing the methods of the invention and how to use them. Moreover, it will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of the other synonyms. The use of examples anywhere in the specification, including examples of any terms discussed herein, is illustrative only, and in no way limits the scope and meaning of the invention or any exemplified term. Likewise, the invention is not limited to its preferred embodiments.

The terms "about" or "approximately" means within an acceptable error range for the particular value as determined by one of ordinary skill in the art, which will depend in part on how the value is measured or determined, i.e., the limitations of the measurement system, i.e., the degree of precision required for a particular purpose, such as a pharmaceutical formulation. For example, "about" can mean within 1 or more than 1 standard deviations, per the practice in the art. Alternatively, "about" can mean a range of up to 20%, preferably up to 10%, more preferably up to 5%, and more preferably still up to 1% of a given value. Alternatively, particularly with respect to biological systems or processes, the term can mean within an order of magnitude, preferably within 5-fold, and more preferably within 2-fold, of a value. Where particular values are described in the application and claims, unless otherwise stated, the term "about" meaning within an acceptable error range for the particular value should be assumed.

Hanger 100

FIGS. 1-13 illustrate an exemplary garment hanger 100 that includes a crossbar 110 that defines a first end 112 and an opposing second end 114. The crossbar 110 has a first face (first surface) 111 and a second face (second surface) 113. Hanger 100 also includes a central portion 120 that defines a hook receiving area. In particular, the central portion 120 includes a hook receiving body 130 that is integral to and extends outwardly from a top edge 116 of the cross bar 110. As mentioned, the garment hanger 100 can be formed of a natural plant fiber or other biodegradable material. In other words and unlike conventional hangers, the garment hanger 100 is a non-plastic product.

The hook receiving body 130 can have a trapezoid shape as shown and includes a through hole 132. The through hole 132 can have a circular shape or in any shape. It will be understood that the hook receiving body 130 can be eliminated and instead, the hook is inserted and secured directly inside the crossbar 110. In this design, the limiter 250, 251, that are described in more detail below are inserted into an opening formed directly in the crossbar 110 since there is no hook receiving body 130.

The crossbar 110 includes a first set of bottom clips 140, 141 that are integral to the cross bar 110. The bottom clips 140, 141 are at the first end 112 and the second end 114. respectively. The integral bottom clips 140, 141 thus depend downward from the crossbar 110 and are generally perpendicular thereto. Each of the bottom clips 140, 141 has a first face (first surface) 142 and an opposite second face (second surface) 144. The first face 142 faces the same direction as the first face 111 of the crossbar 110 and similarly, the second face 144 faces the same direction as the second face 113 of the crossbar 110. The first surface 142 of each bottom clip 140, 141 has a first groove 150 formed therein. The first groove 150 extends traverse across the bottom clip 140, 141 in a direction parallel to a longitudinal axis of the crossbar 110.

In addition, the crossbar 110 includes recesses 160, 162 that are formed in the second face 113. The recess 160 is at the first end 112 of the crossbar 110 and the recess 162 is formed at the second end 114 of the crossbar 110. The recess 160 is open at the first end 112 and has a closed end 161 spaced inward from the first end 112. The recess 162 is open at the second end 114 and has a closed end 163 spaced inward from the second end 114. The recesses 160, 162 are generally formed along a bottom edge of crossbar 110.

The hanger 100 also includes a second set of top clips 170, 171 that are separate from the cross bar 110. The top clips 170, 171 are designed to mate with the bottom clips 140, 141 and in particular, the top clips 170, 171 are superimposed over the bottom clips 140, 141. The top clips 170, 171 are coupled to the bottom clips 140, 141 such that the top clips 170, 171 open and close relative to the bottom clips 140, 141. In the open positions, a garment can be received between the top clips 170, 171 and the bottom clips 140, 141 and when closed, the garment is captured between the top clips 170, 171 and the bottom clips 140, 141.

The top clips 170, 171 includes a first face (first surface) 172 and an opposite second face (second surface) 174. The second face 174 faces the second face 113 of the crossbar 110 and the first face 172 faces away from the second face 113 of the crossbar 110. Along the second face 174 of each top clip 170, 171 there is a second groove 180 and along the first face 172 of each top clip 170, 171 is a third groove 182. The second groove 180 is located closer to the top edge of the top clip 170, 171, while the third groove 182 is located closer to the bottom edge of the top clip 170, 171. Each of the second grooves 180 and third grooves 182 extends completely across the width of the top clip 170, 171 and the grooves 180, 182 are parallel to one another.

The clipping part of this natural plant fiber hanger is mainly composed of a pair of coil springs 200, 210. It will be appreciated that the spring 200 is for use to connect the top clip 170 to the bottom clip 140 and the spring 210 is used to connect the top clip 171 to the bottom clip 141.

The coil spring 200 includes a coiled section 202 and has a first L-shaped arm 204 at one end of the coiled section 202 and a second L-shaped arm 206 at the other end of the coiled section 202. At the free end of the first L-shaped arm 204 there is a first extension torsion lock 205 and at the free end of the second L-shaped arm 206 there is a second extension torsion lock 207. The first and second extension torsion locks 205, 207 act to prevent the top clip 170 from sliding out of the bottom clip 140. As shown in the figures, the first and second extension torsion locks 205, 207 preferably have lengths that allow the free ends to be disposed against a section of the second L-shaped arm 206 and the arm L-shaped arm 204, respectively. In other words, each of the first and second extension torsion locks 205, 207 is captured inside of the second L-shaped arm 206 and the arm L-shaped arm 204, respectively, to prevent the top clips from undesired lateral movement. The extended length of the first and second extension torsion locks 205, 207 and positioning internal to the second L-shaped arm 206 and the first L-shaped arm 204, respectively, allows the top clips to stay in place as shown in the figures. In other words, the L-shaped arms 204, 206 are on top of the extension torsion locks 205, 207 so as to capture and hold the extension torsion locks 205, 207 in place.

Similarly, the coil spring 210 includes a coiled section 212 and has a first L-shaped arm 214 at one end of the coiled section 212 and a second L-shaped arm 216 at the other end of the coiled section 212. At the free end of the first L-shaped arm 214 there is a first extension torsion lock 215 and at the free end of the second L-shaped arm 216 there is a second extension torsion lock 217. The first and second extension torsion locks 215, 217 act to prevent the top clip 170 from sliding out of the bottom clip 140.

As shown in the figures, the first and second extension torsion locks 215, 217 preferably have lengths that allow the free ends to be disposed against a section of the second L-shaped arm 216 and the arm L-shaped arm 214, respectively. In other words, each of the first and second extension torsion locks 215, 217 is captured inside of the second L-shaped arm 216 and the arm L-shaped arm 214, respectively, to prevent the top clips from undesired lateral movement. The extended length of the first and second extension torsion locks 215, 217 and positioning internal to the second L-shaped arm 216 and the first L-shaped arm 214, respectively, allows the top clips to stay in place as shown in the figures. In other words, the L-shaped arms 214, 216 are on top of the extension torsion locks 215, 217 so as to capture and hold the extension torsion locks 215, 217 in place.

The first L-shaped arm 204 is inserted into the third groove 182 with the first torsion lock 205 being seated along a first (side) edge of the top clip 170. The coiled section 202 seats within the second groove 180. The second L-shaped arm 206 is inserted into the first groove 150 with the second torsion lock 207 seating along a second (side) edge of the bottom clip 140. In other words, one L-shaped arm (i.e., the first L-shaped arm 204) extends along the exposed outer face of the top clip 170, while the other L-shaped arm (i.e., the second L-shaped arm 206) extends along the exposed outer face of the bottom clip 140.

The first L-shaped arm 214 is inserted into the third groove 182 with the first torsion lock 215 being seated along a first (side) edge of the top clip 171. The coiled section 212 seats within the second groove 180. The second L-shaped arm 216 is inserted into the first groove 150 with the second torsion lock 217 seating along a second (side) edge of the bottom clip 141. In other words, one L-shaped arm (i.e., the first L-shaped arm 214) extends along the exposed outer face of the top clip 171, while the other L-shaped arm (i.e., the second L-shaped arm 216) extends along the exposed outer face of the bottom clip 141.

By using a spring to create a circular coil spring 200, 210 the coil section 202, 212 is placed between the top clip 170, 171 and the corresponding bottom clip 140, 141 to create a support point. It will also be appreciated that when the top of the top clip 170, 171 is pressed down, the bottom part of bottom clips 140, 141 and top clip 170, 171 open up so that the item or clothing to be hung can be placed inside the clips 140, 141, 170, 171.

The L-shaped arms 204, 206 and L-shaped arms 214, 216 extend from the (left) coil spring 200 and the right coil spring 210, respectively, and apply pressure to the outer surfaces of the top clips 170, 171 and the bottom clips 140, 141, respectively, ensuring that the item or clothing being hung is securely held in between the top clips 170, 171 and the bottom clips 140, 141 and will not fall out. The L-shaped arms 204, 206 and the L-shaped arms 214, 216 press the outer surface of top clips 170, 171 and bottom clips 140, 141 together also for preventing them separating.

As mentioned, the L-shaped arms 204, 206 are equipped extension torsion locks 205, 207, respectively, to prevent the top clip 170 from sliding out from the bottom clip 140.

Similarly, the end of L-shaped arms 214, 216 are equipped with extension torsion locks 215, 217, respectively, to prevent the top clip 171 sliding out from the bottom clip 141. As mentioned, both the inner and outer surfaces of the bottom clips 140, 141 and the top clips 170, 171 have semi-circular recesses 160, 162, 180, which are used to secure the coil springs 200, 210 in place. The ends 161, 163 of the recesses 160, 162 on the bottom clips 140, 141 also serve as an interception that prevent the coil springs 200, 210 from sliding out of the bottom clips 140, 141. Also, the grooves 150, 182 formed in outer surfaces of bottom clips 140, 141 and the top clips 170, 171 store parts (linear sections) of the L-shaped arms 204, 206, 214, 216, thereby keeping the coil springs 200, 210 in a fixed position.

In order to prevent the hanger from breaking when the hook 10 is shaken or bent and causing the hook 10 to loosen and detach, there is an opening 132 in any shape located beneath the hook 10 penetrated from the front side to the back side of the hanger crossbar 110. Inside the opening 132, a hollow semi solid or solid hook swing limiter (Limiter) 250, according to a first embodiment, 132 (FIG. 12) is plugged inside the opening 132. The limiter has the same shape and almost in the same size as the opening 132 to permit a snug friction (interference) fit therebetween. It will be appreciated that the limiter 250 is first placed inside the opening 132 and then the hook 10 is inserted into the limited from the top.

The limiter 250 has an upper hole 252 and a lower hole 254 on the top and bottom, respectively, of the limiter 250. The upper hole 252 and lower hole 254 are thus axially aligned. When the hanger hook 10 passes through the upper hole 252 and lower hole 254 of the limiter 250 and is inserted into the bottom of the hanger 100, the top hole 252 and bottom hole 254 of the limiter 250 secure the hanger hook 10 in place. The whole surface around the side wall of the limiter 250 and the side surface around the opening 132 are tightly pressed against and contact each other. There is almost no space between the limiter 250 and the opening 132.

It will also be appreciated that since the limiter 250 can be made of a solid piece of plastic without preformed holes 252, 254, the metal bottom of the hook 10 can be pre-heated and then inserted directly into the limiter 250 since the heated hook 10 will melt the plastic limited 250 and allow passage of the hook 10 into the inside of the limiter 250. As shown, the threaded bottom end of the hook 10 assists in screwing and anchoring the hook 10 into the pre-heated limiter.

Figures 6A, 6B, 6C:
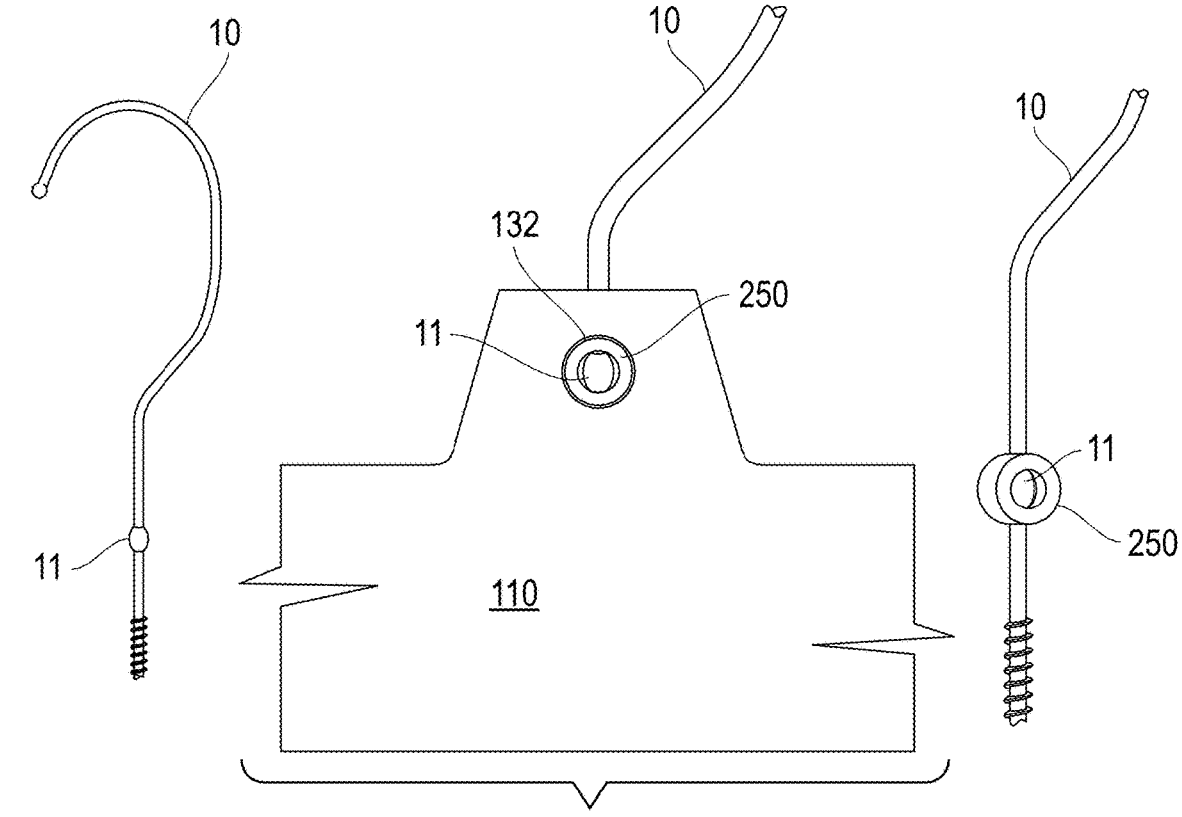
FIG. 6A is a front view of the hanger hook.
FIG. 6B is a front view of the hanger hook with hook swing limiter inserted into a hole in the cross bar.
FIG. 6C is a front view showing the hanger hook coupled to the hook swing limiter.
Figure 7A:
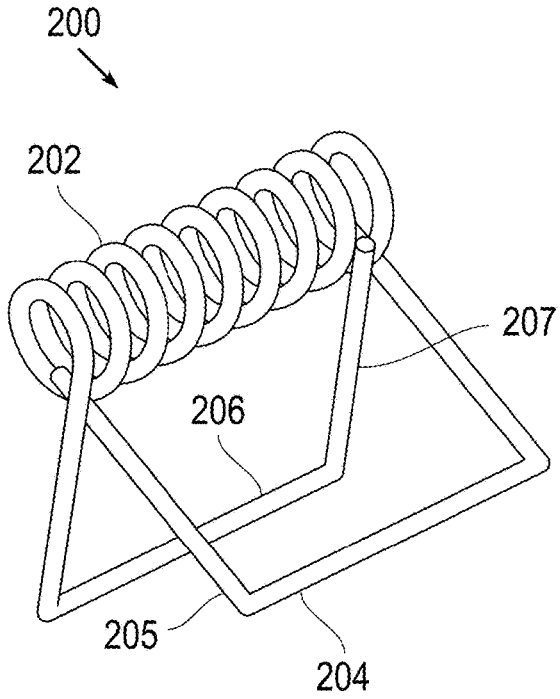
FIG. 7A is a first coil spring for use with a movable clip.
Figure 7B:
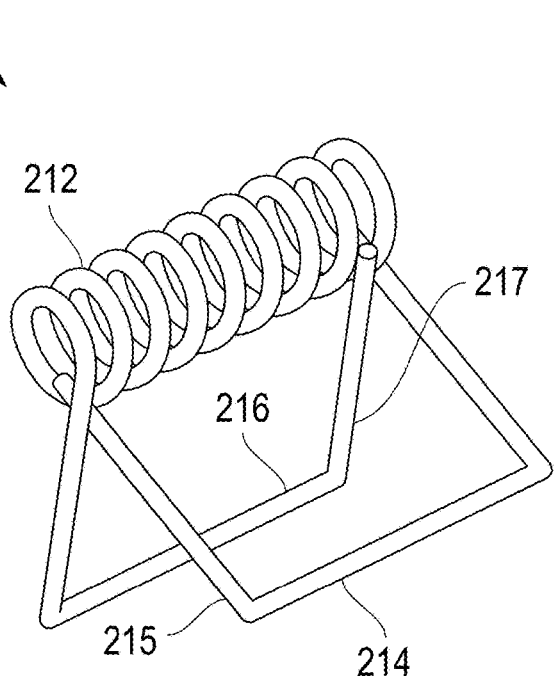
FIG. 7B is a second coil spring for use with the movable clip.
Figure 8A:
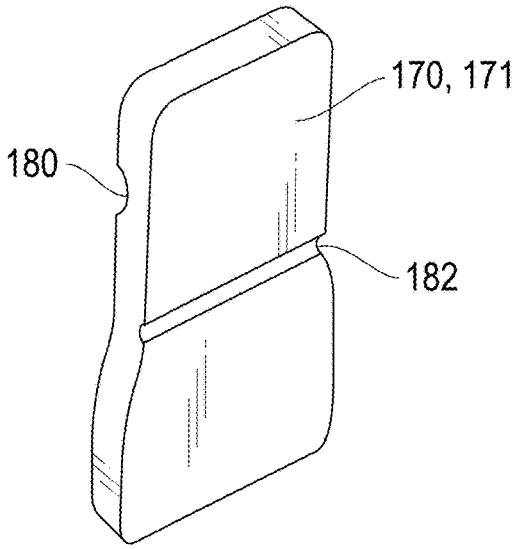
FIG. 8A is a front perspective view of the movable clip.
Figure 8B:
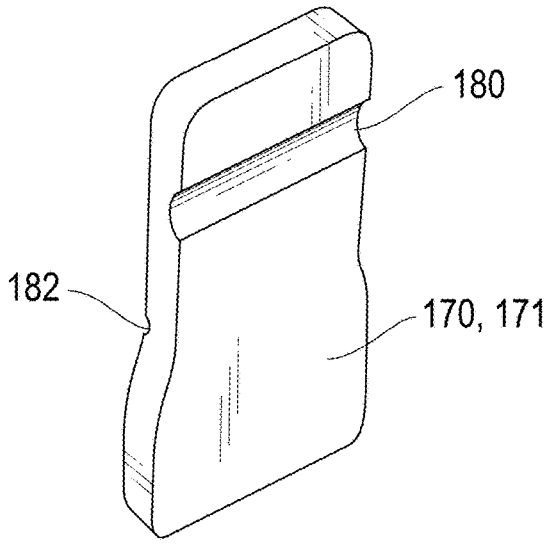
FIG. 8B is a rear perspective view of the movable clip.
Figure 9A:
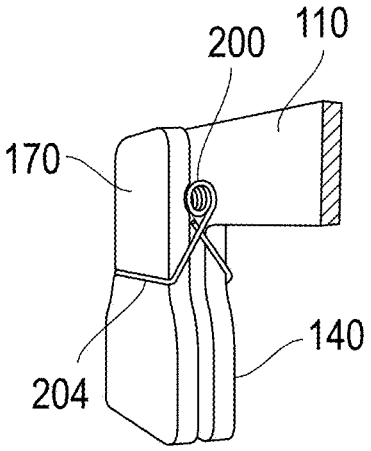
FIG. 9A is a partial front perspective view of a first end of the hanger.
Figure 9B:
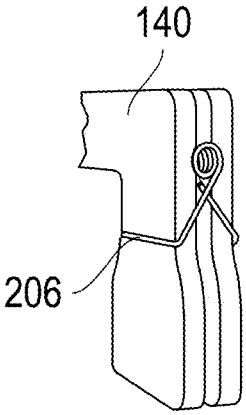
FIG. 9B is a partial rear perspective view of the first end of the hanger.
Figure 10A:
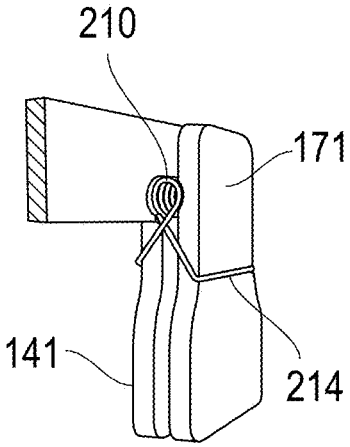
FIG. 10A is a partial front perspective view of a second end of the hanger.
Figure 10B:
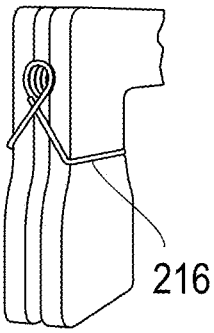
FIG. 10B is a partial rear perspective view of the second end of the hanger.

Due to the limiter 250 being surrounded and tightly squeezed from all sides by opening 132, the limiter 250 is firmly fixed in place and unable to move from its current position. Therefore, this prevents the hook 10 from being bent or swinging forward and backward, which can cause damage to the body of the hanger and also result in the hook 10 becoming detached. The section of the hook 10 that is located at the opening 132 will be flattened 11 after it is inserted into the hollow or semi hollow limiter 250 for preventing the hanger hook 10 from being pulled out from the limiter 250. FIG. 6C shows the limiter 250 installed on the hook 10 only for illustration purposes, while FIG. 6B illustrates the limiter 250 inserted opening 132.

Figure 13:
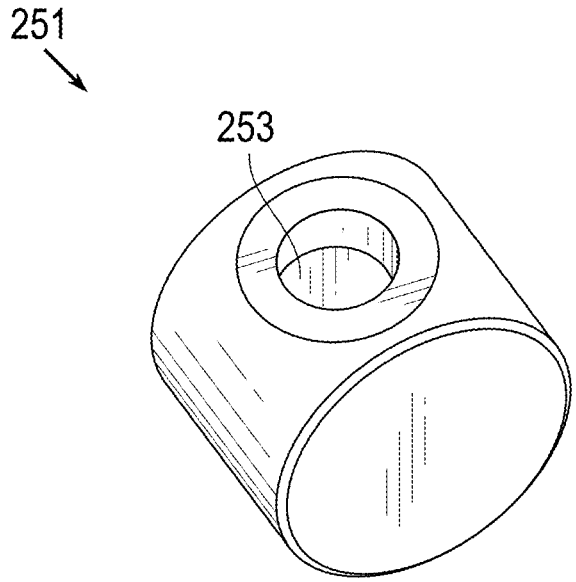
FIG. 13 is a top and side perspective view of a second hook swing limiter.

Now referring to FIG. 13, when a solid limiter 251 is applied, the hook 10 will be locked by the lower thread of the hook 10 for preventing the hanger hook 10 from coming out. In other words, the hook 10 is threadingly attached to a threaded bore 253 formed in the limiter 251. The limiter 251, like limiter 250, is inserted into 132 such that it is fixed in place within the opening 132.

Figure 3:
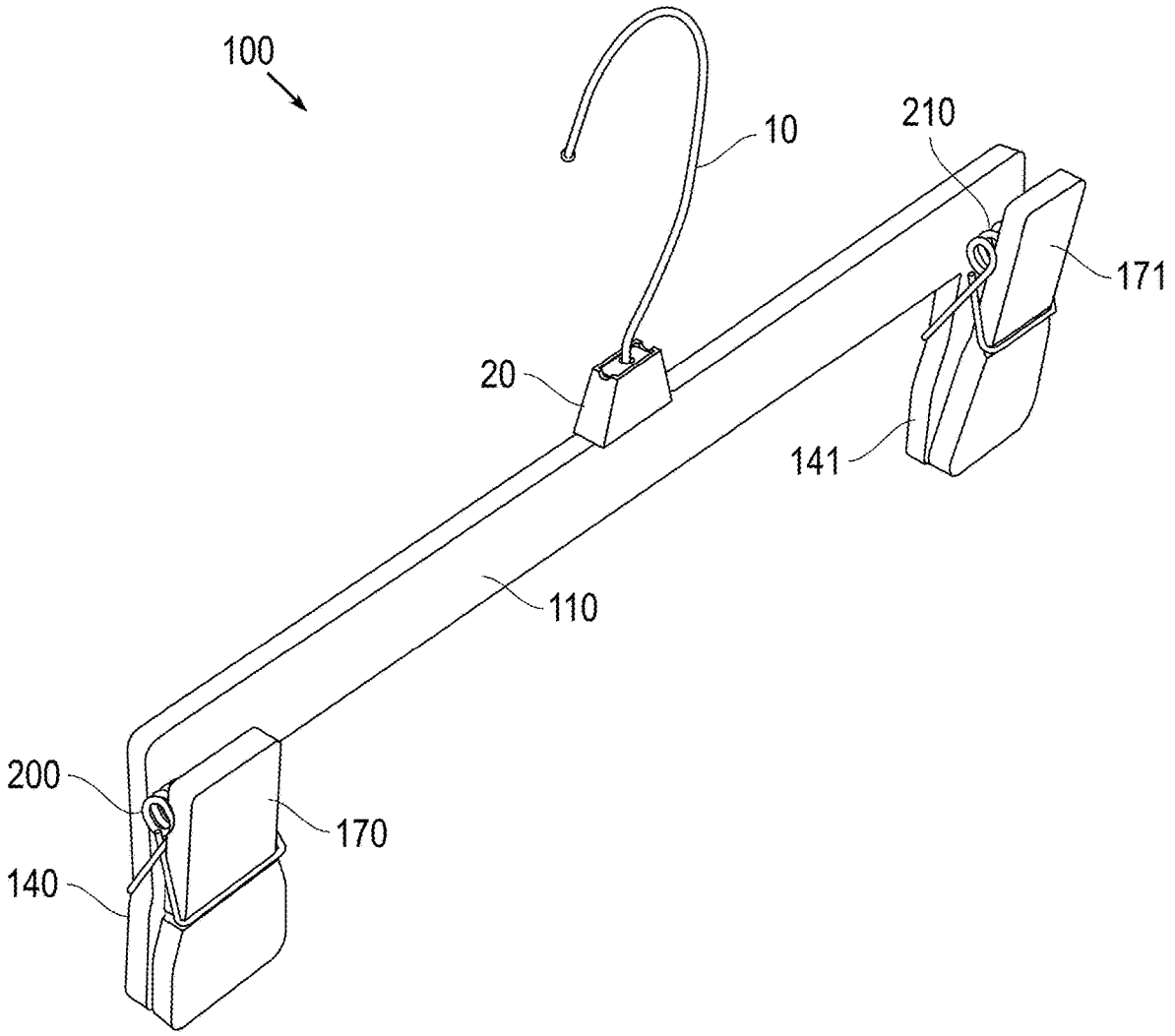
FIG. 3 is a front perspective view thereof with a top sizer inserted on a hanger hook.
Figure 4:
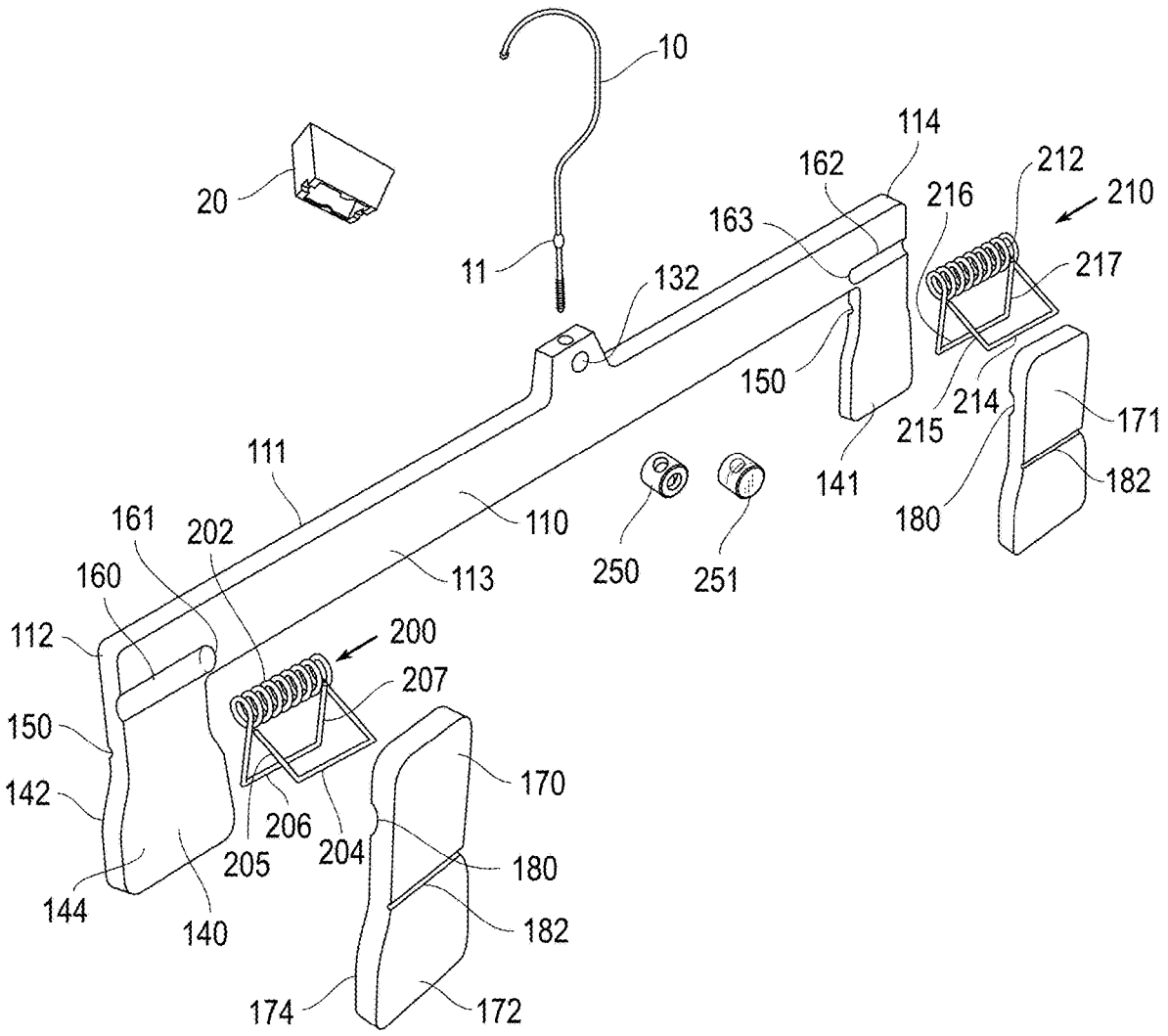
FIG. 4 is an exploded front perspective view thereof.
Figure 5:
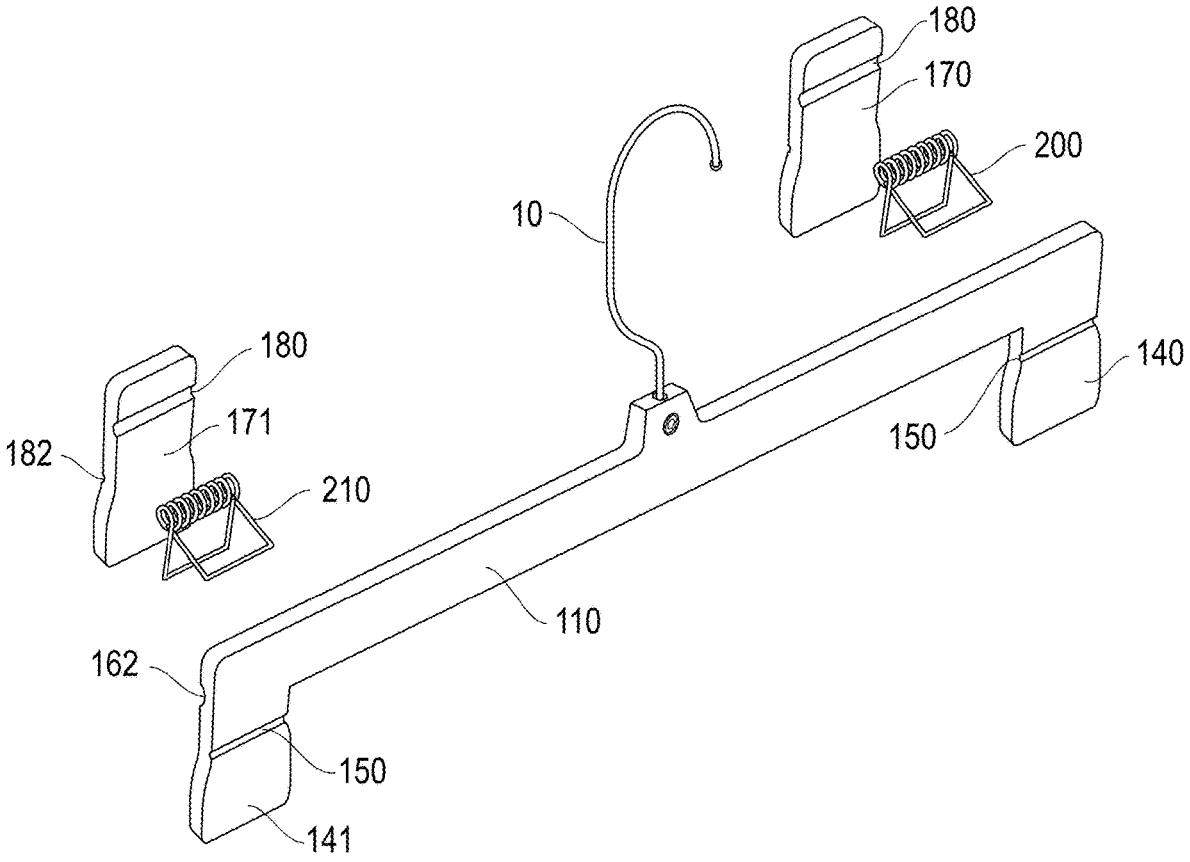
FIG. 5 is an exploded rear perspective view thereof.
Figure 11:
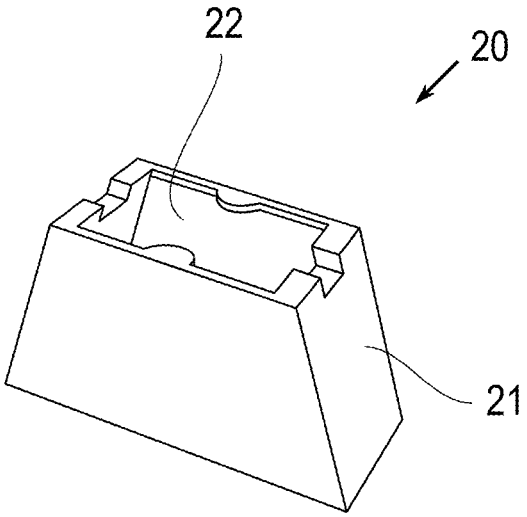
FIG. 11 is a top and side perspective view of a top sizer.
Figure 12:
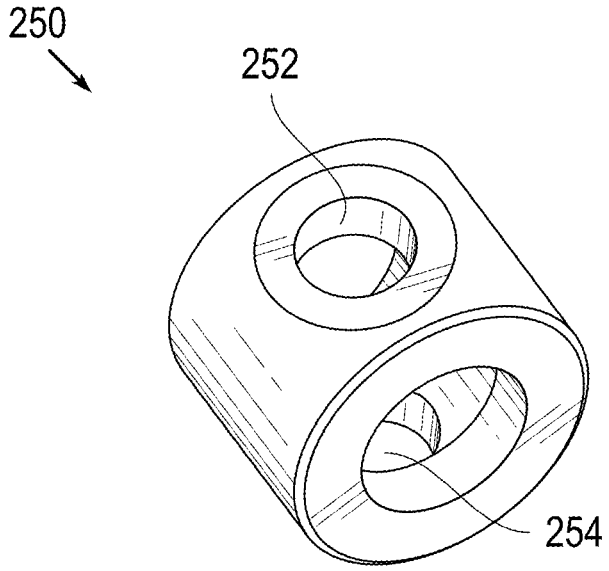
FIG. 12 is a top and side perspective view of a first hook swing limiter.

As shown in FIG. 3, when a size marker, commonly referred to as a top sizer, 20 is inserted from the top of the hook into the hanger, the opening 132 is covered to prevent it from being exposed. One exemplary top sizer 20 is shown in FIG. 11 and includes a hollow body 21 with a top opening 22 and an opposite bottom opening that allows the top sizer 20 to initially be inserted over the book 10 and then inserted over the hook receiving body 130.

As mentioned, the hanger 100 comprises an eco-friendly in that the clips and crossbar can be formed of a biodegradable material, such as wood (e.g., recycled wood, pressed wood, etc.).

Hanger 300

Now referring to FIGS. 14-19B, hanger 300, like hanger 100, comprises an eco-friendly hanger that can be formed of a biodegradable material, such as wood. The hanger 300 utilizes some of the same components as hanger 100 and therefore, like elements are numbered alike. The main difference between the hanger 300 and hanger 100 is that the hanger 300 has a different crossbar 310 construction that permits the two pairs of clips to be moved so that a distance therebetween can be adjusted. Such clip adjustment allows the clips to be placed in desired grip locations of the garment and allows the hanger 300 to accommodate different sized clothing and/or different types of clothing.

The crossbar 310 that defines a first end 312 and an opposing second end 314. The crossbar 310 has a first face (first surface) 311 and a second face (second surface) 313. Hanger 300 also includes a central portion that defines a hook receiving area. In particular, the central portion includes a hook receiving body 330 that is integral to and extends outwardly from a top edge 316 of the cross bar 310. As mentioned, the garment hanger 300 can be formed of a natural plant fiber (e.g., wood) or other biodegradable material. In other words and unlike conventional hangers, the garment hanger 300 is a non-plastic product (with the exception of the hook 10, springs 200, 210, inner frame 390, hook swing limiter 250, 251 and top sizer 20).

The hook receiving body 339 can have a trapezoid shape as shown and includes a through hole 327. The through hole 327 can have a circular shape or other shape.

The crossbar 310 has a first longitudinal slot 330 and a second longitudinal slot 332. The first longitudinal slot 330 is closer to but spaced from the first end 312, while the second longitudinal slot 332 is closer to but spaced from the second end 314. The first and second longitudinal slots 330, 332 are spaced from one another and do not communicate with one another. Each of the first and second longitudinal slots 330, 332 can be formed to have different shapes with each having a rectangular shape as illustrated. The slots 330, 332 extend completely through the crossbar 310 and thus are open along each face of the crossbar. The slots 330, 332 preferably have the same lengths. In addition, indicia, such as markings can be located above or below the slots 330, 332 and on the crossbar to indicate relative positions within the slots 330, 332.

Figure 19B:
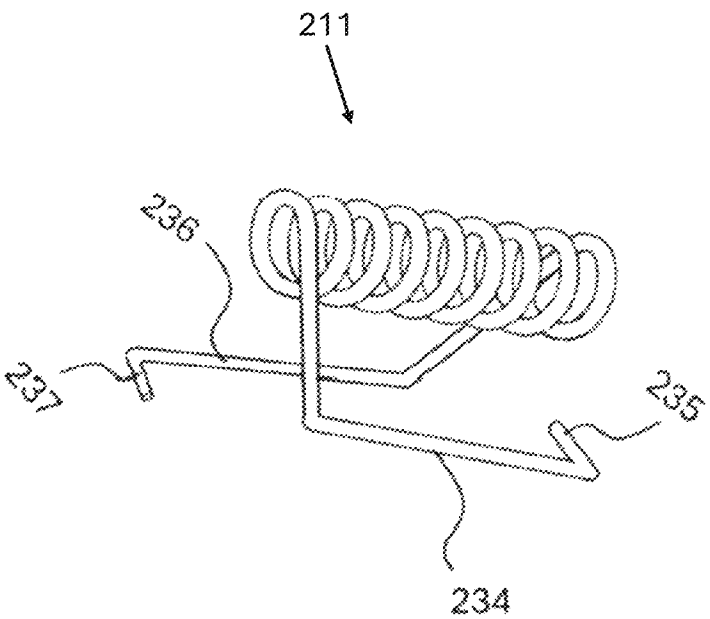
FIG. 19B is a second coil spring for the hanger of FIG. 14.
Figure 19A:
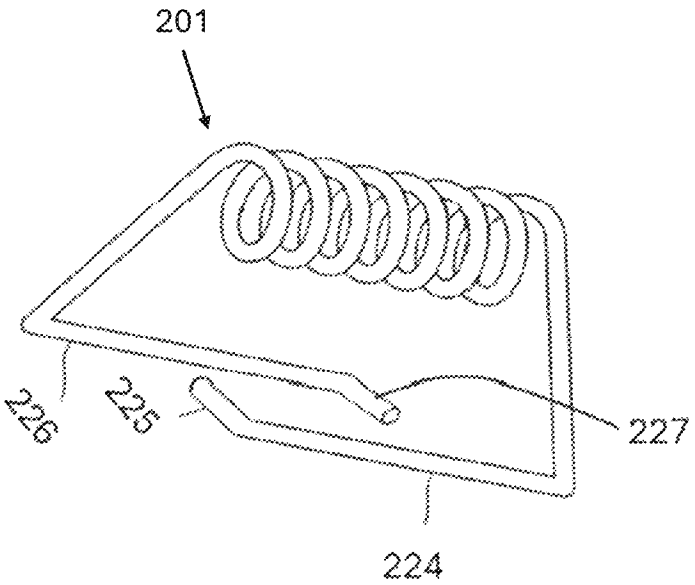
FIG. 19A is a perspective view of a first coil spring for the hanger of FIG. 14.

In accordance with this embodiment, each of the slots 330, 332 is configured to accommodate one of the coil springs 201, 211 and more specifically, the slot 330 receives the coil spring 201 and the slot 332 receives the coil spring 211. FIGS. 19A and 19B illustrate the coil springs 201, 211.

With each slot 330, 332 there is an inner frame 390 that is securely positioned and held therein. The inner frame 390 has a complementary size and shape relative to the respective slot 330, 332. Thus, in the illustrated embodiment, the inner frame 390 has a rectangular shape and has a hollow center (interior) to allow receipt of the coil spring 201, 211. Along both the top edge and bottom edge of the inner frame 390, there surface of the inner frame 390 is modified and more particularly, provides a grip/friction surface 392. For example, the top edge and bottom edge can be a roughened surface and in illustrated embodiment, each of the top edge and the bottom edge comprises a grooved surface 392 in that it can be formed to have a series of ridges that define grooves or valleys between the ridges. The grooved surface is constructed in view of the construction of the coiled section of the spring since it is desired and intended that the windings of the coiled section become captured within the grooved surface 392. Since the windings are circular in shape, the windings contact and engage the grooved surface 392 along both the top edge and the bottom edge, thereby securely locking the coiled spring in place within the inner frame due to the interlocking and the friction generated between the coil springs 201, 211 and the inner frame 390.

The inner frame 390 also includes an angled cover or flange 394 that is located along the top edge and the bottom edge and protrudes outwardly from the inner frame 390. Thus, there is an upper and lower cover 394 along the first face (first surface) 311 and there is an upper and lower cover 394 along the second face (second surface) 313. These covers 394 prevent the coil spring 211 from sliding out of the inner frame 390. In combination with the grooved surface 392, the coil springs 201, 211 are securely retained and held in place within the inner frame 390.

The hanger 300 includes a plurality of clips 350 with the clips 350 defining two different pairs of clips 350, one pair closer to the first end 312 and the other pair closer to the second end 314. Each clip 350 can be the same as the clips 170, 171. Accordingly, each clip 350 has an inner face (surface) 352 and an opposite outer face (surface) 354. Along the inner face 352 there is a first groove 360 that is configured to receive a portion of the respective coil spring 201, 211. The first groove 360 can have a semi-circular shape as shown and extends across the entire width of the clip and is open along both side edges of the clip. On the outer face 354 there is a second groove or channel 362 that extends across the entire width of the clip and is open along both side edges of the clip.

Similar to the prior embodiment, at the free end of the first L-shaped arm 224 there is a first extension torsion lock 225 and at the free end of the second L-shaped arm 226 there is a second extension torsion lock 227. The first and second extension torsion locks 225, 227 act to secure the springs to the clips.

Similar to the prior embodiment, at the free end of the first L-shaped arm 234 there is a first extension torsion lock 235 and at the free end of the second L-shaped arm 236 there is a second extension torsion lock 237. The first and second extension torsion locks 235, 237 act to secure the springs to the clips.

In this embodiment, the L-shaped arm 224 is received in the second groove 362 of one clip of the one pair of clips 350 and the L-shaped arm 226 is received in the second groove 362 of the other clip of the one pair of the clips 350. The L-shaped arm 234 is received in the second groove 362 of one clip of the other pair of clips 350 and the L-shaped arm 236 is received in the second groove 362 of the other clip of the other pair of the clips 350.

In this embodiment, unlike the first embodiment of FIGS. 1-13, there are four loose clips 350 that are coupled to the crossbar in such a way that they can pivot between open and closed positions yet can be detached and removed from the crossbar 310.

Figure 14:
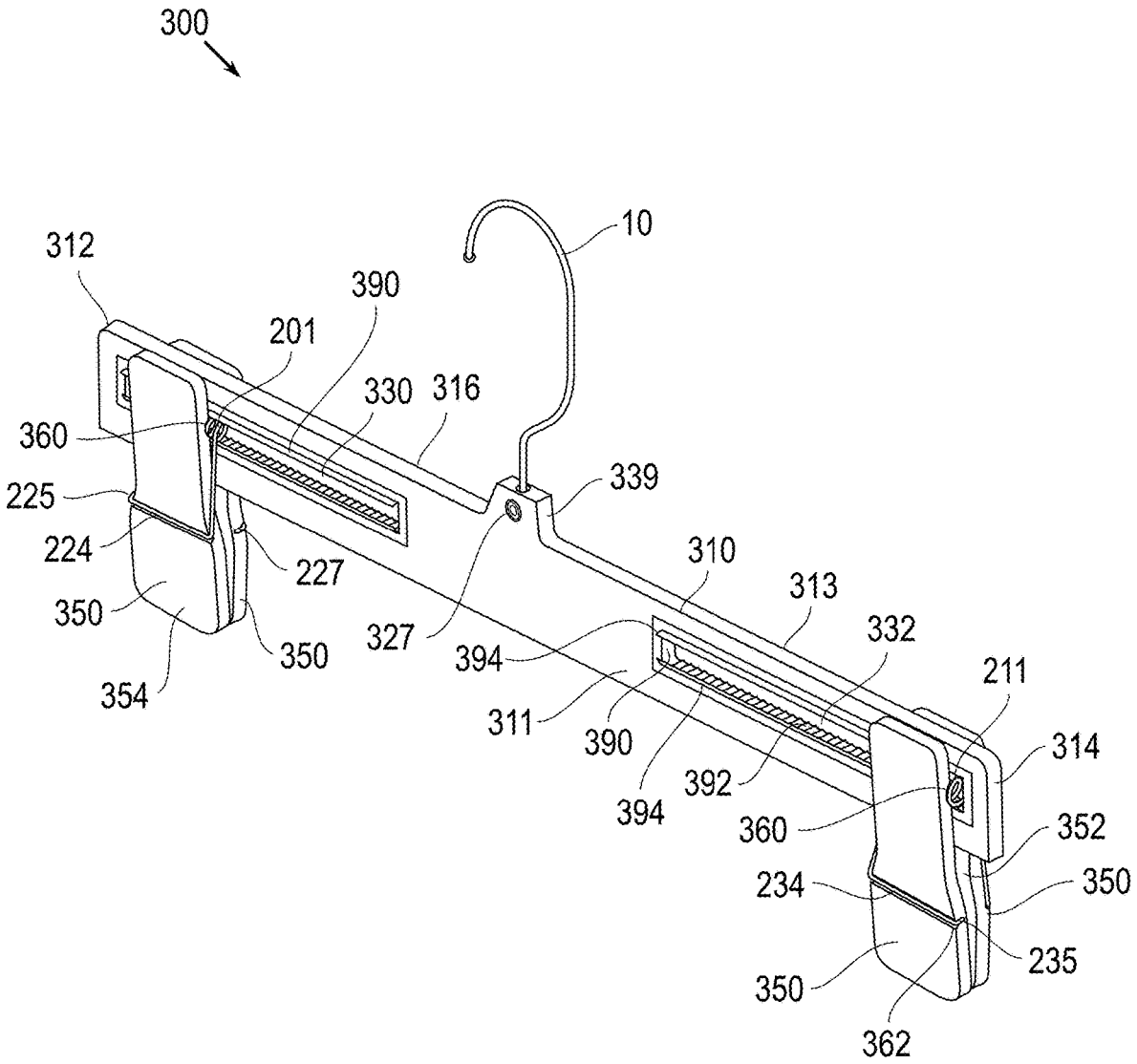
FIG. 14 is a front perspective view of an eco-friendly hanger according to a second embodiment and showing movable clips in a first position.
Figure 15:
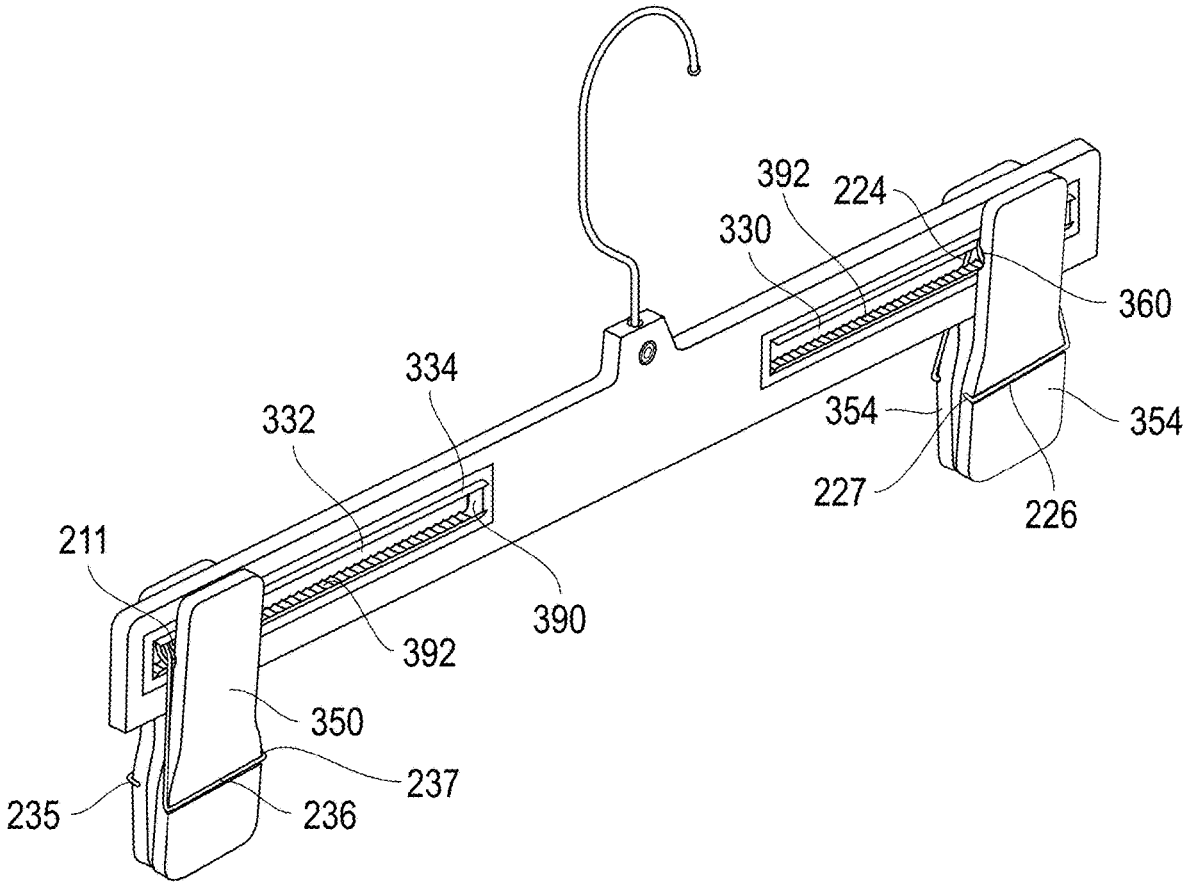
FIG. 15 is a rear perspective view thereof.
Figure 16:
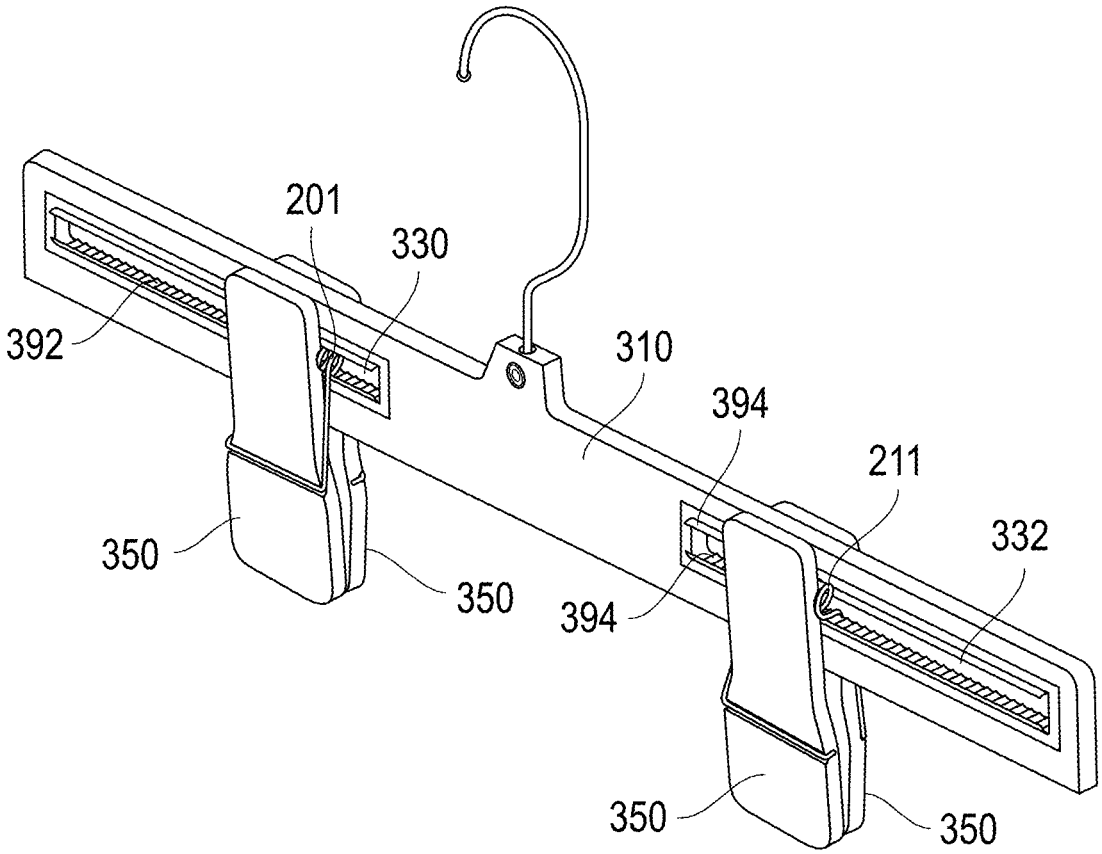
FIG. 16 is another front perspective view thereof with the movable clips in a second position.
Figure 17:
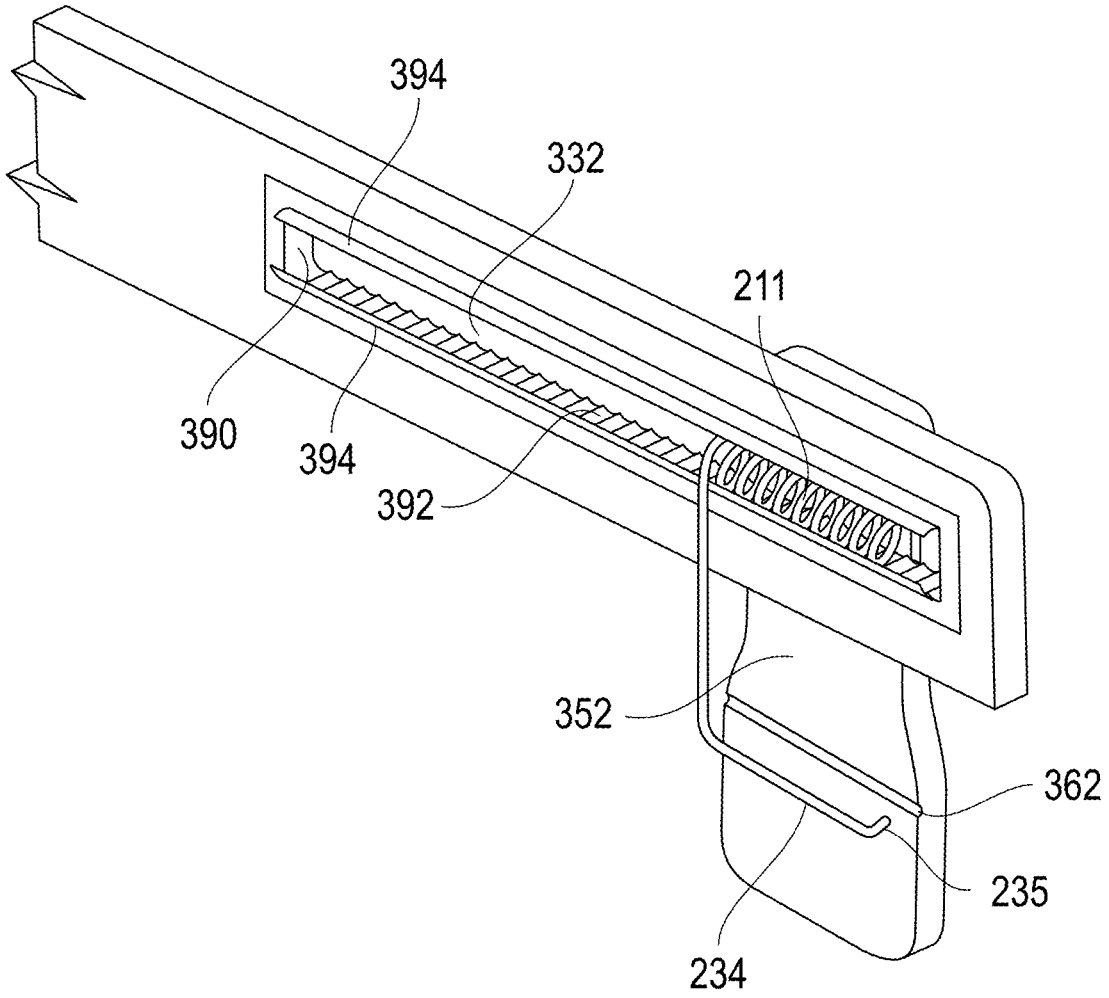
FIG. 17 is a partial perspective view of one end of the hanger with one clip removed to illustrate the crossbar and coil spring.

Moreover, as mentioned, the two pairs of the clips 350 can slide longitudinally along the crossbar 310 to allow adjustment due to the coil spring 201, 211 being accommodated in the slots 330, 332. FIGS. 14-15 show the two pairs of clips 350 in a first position relative to the crossbar 310, while FIG. 16 shows the two pairs of clips 350 in a second position. To adjust, the user grasps one pair of the clips 350 and with force slides them in the respective slot.

However, the forces of the spring arms of the two coil springs 201, 211 prevent the clips 350 from inadvertently and easily sliding within the slots and thereby moving along the crossbar 310.

Accordingly, in this second embodiment, the eco-friendly hanger 300 has adjustable clips 350 that permit the clipping locations and clip distance to be altered.

Figure 18:
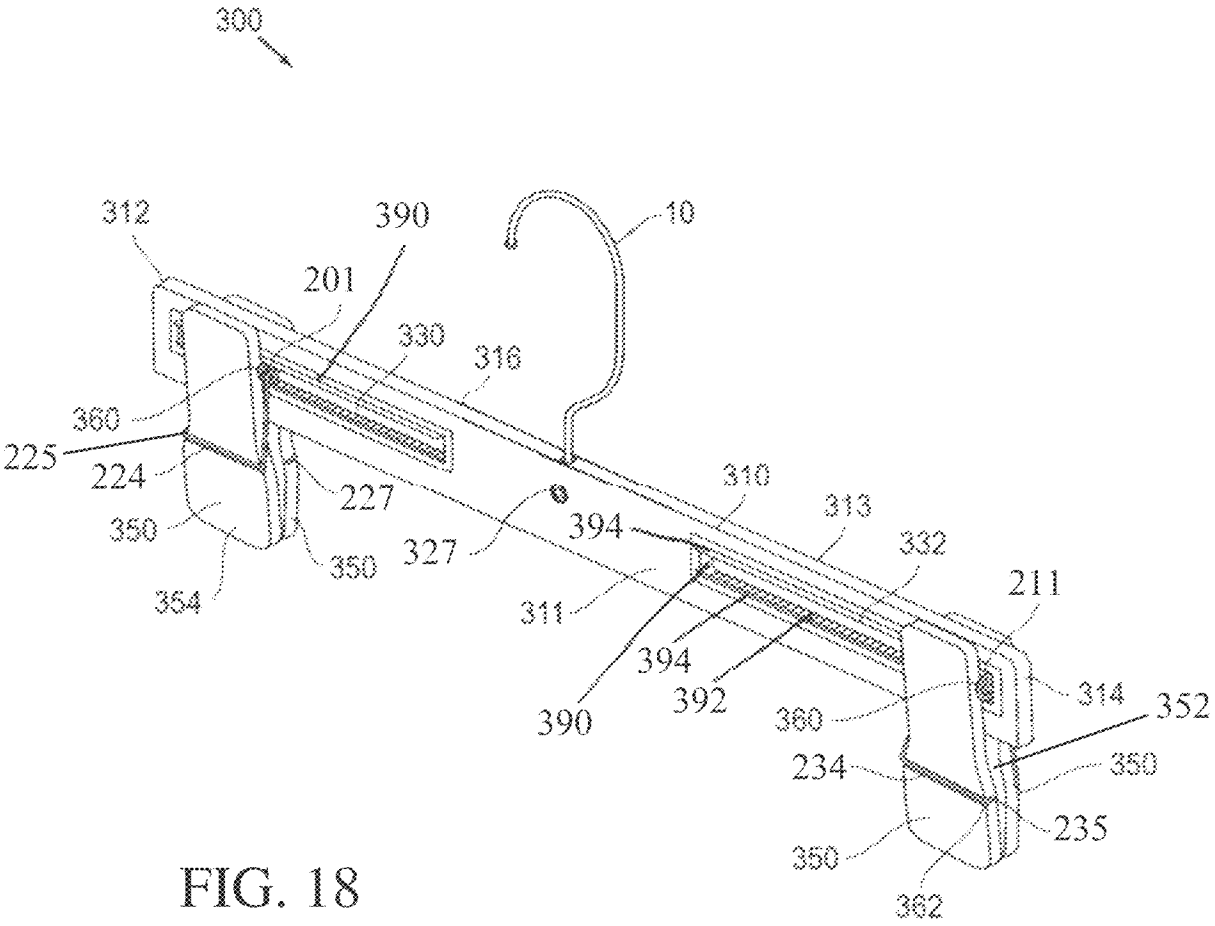
FIG. 18 is a perspective view of another embodiment of the hanger.

FIG. 18 shows another embodiment of the hanger 300 in which the hook 10 is directly connected to the flat crossbar. In other words, the limier is inserted into an opening in the crossbar and there is no raised hook receiving body.

While, the hangers disclosed herein are preferably part of an eco-friendly hanger design, it will be appreciated that the teachings disclosed herein can be implemented in hangers that do not have eco-friendly properties.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A hanger comprising:

a crossbar having a first end and an opposing second end and a hook receiving portion along a top edge between the first and second ends;

a pair of first clips and a pair of second clips, each of the pair of first clips and the pair of second clips moving between an open position configured to receive an article and a closed position configured to grasp the article, each of the pair of first clips and the pair of second clips comprising a clip body that is separate and detachable from the crossbar, the pair of first clips being disposed on opposite sides of the crossbar and the pair of second clips being disposed on opposite sides of the crossbar; and first and second coil springs, the first coil spring biasedly coupling the pair of first clips to one another and being located between the pair of first clips, the second coil spring biasedly coupling the pair of second clips to one another and being located between the pair of second clips, wherein the first coil spring includes a first spring arm that is coupled to one first clip and a second spring arm that is coupled to the other first clip such that in an at rest state, the pair of first clips are in the closed position, wherein the second coil spring includes a first spring arm that is coupled to one second clip and a second spring arm that is coupled to the other second clip such that in an at rest state, the pair of second clips are in the closed position;

wherein the crossbar includes a first slot formed completely through the crossbar from a front face to a rear face and a second slot formed completely through the crossbar from the front face to the rear face, each of the first slot and the second slot extending longitudinally along a length of the crossbar, the first coil spring being partially received within the first slot and the second coil spring being partially received within the second slot;

wherein the first slot is defined by a first grooved bottom wall defining a bottom of the first slot and the second slot is defined by a second grooved bottom wall defining a bottom of the second slot, wherein a coil portion of the first coil spring is in contact with the first grooved bottom wall for gripping and holding the first coil spring in a given location and a coil portion of the second coil spring is in contact with the second grooved bottom wall for gripping and holding the second coil spring in a given location.

2. The hanger of claim 1, wherein the crossbar and the first and second clips are formed of a biodegradable material.

3. The hanger of claim 2, wherein the biodegradable material comprises wood.

4. The hanger of claim 1, wherein each of the first spring arm and the second spring arm of each of the first coil spring and the second coil spring has an L-shape.

5. The hanger of claim 4, wherein each first spring arm has a first extension torsion lock at a free end thereof and each second spring arm has a second extension torsion lock at a free end thereof.

6. The hanger of claim 5, where each of the first extension torsion lock comprises a bent end that wraps around one edge of the respective one first clip or the other first clip and each of the second extension torsion lock comprises a bent end that wraps around an opposite edge of the respective one second clip or the other second clip.

7. The hanger of claim 1, further including a hook secured to the hook receiving portion of the crossbar.

8. The hanger of claim 7, further including a hook swing limiter that is received within a hole formed in the hook receiving portion and is attached to the hook, the hook swing limiter being configured to prevent movement of the hook relative to the crossbar.

9. The hanger of claim 8, wherein the hook has a threaded bottom end and the hook swing limiter is pre-heated to allow the threaded bottom end to be anchored within the pre-heated hook swing limiter.

10. The hanger of claim 8, wherein the hook swing limiter has a threaded bore that mates with outer threads formed at a bottom section of the hook.

11. The hanger of claim 1, wherein the first slot is defined by a first top wall in the form of an angled flange that protrudes outward for covering the first coil spring, the first top wall defining a top of the first slot and wherein the second slot is defined by a second top wall in the form of an angled flange that protrudes outward for covering the second coil spring, the second top wall defining a top of the second slot.

* * * * *